US005474355A

United States Patent [19]

Lerner et al.

[11] Patent Number: 5,474,355

[45] Date of Patent: Dec. 12, 1995

[54] COMBINATION BOOSTER SEAT AND HIGH CHAIR

[75] Inventors: Michael I. Lerner, Boston, Mass.; David W. Crossley, Woonsocket, R.I.; Randy L. Abrams, Leominster; Edward C. Owen, New Bedford, both of Mass.

[73] Assignee: Safety 1st, Inc., Chestnut Hill, Mass.

[21] Appl. No.: 188,201

[22] Filed: Jan. 28, 1994

[51] Int. Cl.[6] ..... A47D 1/02

[52] U.S. Cl. ..... 297/36; 297/256.11; 297/411.31; 297/440.15

[58] Field of Search ..... 297/17, 36, 41, 297/153, 256.11, 411.27, 411.31, 440.15, 250.1

[56] References Cited

U.S. PATENT DOCUMENTS

| | | | |
|---|---|---|---|
| D. 314,674 | 2/1991 | Kohus et al. . | |
| D. 330,842 | 11/1992 | Meeker . | |
| 933,624 | 9/1909 | Chandler | 297/36 |
| 1,739,366 | 12/1929 | Lang . | |
| 2,019,005 | 10/1935 | Erickson | 297/36 |
| 2,466,350 | 4/1949 | Anderson . | |
| 3,078,101 | 2/1963 | Reese et al. . | |
| 3,335,434 | 8/1967 | Gamon . | |
| 3,575,465 | 4/1971 | Dolby et al. . | |
| 4,244,619 | 1/1981 | Yoshimura | 297/36 X |
| 4,453,764 | 6/1984 | Hennessy . | |
| 4,586,747 | 5/1986 | Taylor . | |
| 4,603,903 | 8/1986 | Moscovitch . | |
| 4,770,468 | 9/1988 | Shubin . | |
| 4,854,638 | 8/1989 | Marcus et al. . | |
| 5,125,717 | 6/1992 | Skold et al. | 297/256.11 |
| 5,183,311 | 2/1993 | Meeker . | |

FOREIGN PATENT DOCUMENTS

| | | | |
|---|---|---|---|
| 826960 | 1/1952 | Germany | 297/36 |
| 220199 | 2/1959 | United Kingdom . | |

OTHER PUBLICATIONS

Dolly, Inc. Flyer Go'n'Grow 04099 Jul. 1991 (6 pages).

*Primary Examiner*—Peter R. Brown
*Attorney, Agent, or Firm*—Wolf, Greenfield & Sacks

[57] ABSTRACT

A combination booster seat and high chair having a back member and a pair of arm panels pivotally connected to the sides of the back member. The arms move between an operative position wherein they are disposed essentially perpendicular to and extending forward of the back member and an inoperative position wherein they lie in a plane closely adjacent to and parallel with the back member. A seat is detachably connected to both the back member and the arms panels and may be pivoted to a vertical position on the back member when the unit is in the inoperative position so that the seat panel lies between the back member and the side panels. A tray is detachably connected to the side panels and may be removed when the unit is in the inoperative position and stored adjacent the seat between the back member and the arm panels. The height of the seat may be varied by inverting it in the operative position, and the tray may be adjusted toward and away from the back member.

23 Claims, 7 Drawing Sheets

COMBINATION BOOSTER SEAT AND HIGH CHAIR

INTRODUCTION

This invention relates to seats for children and more particularly comprises a new and improved booster seat which will also function as a high chair.

A number of improvements have been made in the booster seat art in recent years. While the early booster seats had a fixed seat and therefore were not adjustable, and they were designed only for use as a booster seat, more recently improvements have been made in the field which have made the seats adjustable so that they may accommodate very small as well as larger children, and they have been made more versatile by providing them with trays which enable the booster seats to function as high chairs. U.S. Pat. No. 4,854,638 shows such a booster seat wherein the back rest and seat panel may be moved back and forth, and up and down respectively, and the assembly includes a detachable tray. Another booster seat found in the prior art has an invertible seat panel which allows the seating surface to be raised or lowered depending upon which seating surface is utilized. That arrangement is shown in U.S. Pat. No. 4,586,747. Other prior art patents that show children's seats that are collapsible such as U.S. Pat. Nos. 1,739,366 and 4,603,903, while other adjustable child's seats are shown in U.S. Pat. Nos. D330,842 and D314,674.

The principle object of the present invention is to provide a combination booster seat and high chair which is both collapsible and adjustable.

Another important object of the present invention is to provide a collapsible combination booster seat and high chair which when collapsed for toting or storage is a compact package without any loose parts.

Another object of the present invention is to provide a combination booster seat and high chair that is relatively inexpensive to manufacture and which therefore may be sold for a modest price while providing maximum convenience and versatility to its owner.

To accomplish these and other objects, the combination booster seat and high chair of the present invention is made up of five major parts, namely, a back member, a pair of arm panels, a seat panel and a tray. The arm panels are pivotally connected to the back member and are movable between an operative position wherein they extend forwardly generally perpendicular to the plane of the back member and a collapsed position wherein the arm panels are coplanar with one another closely adjacent and parallel to the plane of the back member. The seat panel is detachable from the back member and arm panels and is pivotally mounted on the back panel so that it may be raised to a perpendicular position inside the folded arm panels and in front of the back member. The tray is removable from the arm panels and when the combination booster seat and high chair is collapsed, the tray may be placed between the back member and arm panels adjacent the seat panel. The height of the seat may be adjusted by inverting it on the arm panels and back member, and the tray may be adjusted by releasably locking it in one of two positions on the arm panels. A conventional strap arrangement may be provided to hold the child in the seat, and additional straps may be used to secure the seat to a chair on which it is placed.

These and other objects and features of the present invention will be better understood and appreciated from the following detailed description of the preferred embodiment thereof, shown in the accompanying drawings.

DETAILED DESCRIPTION

Figure 1:
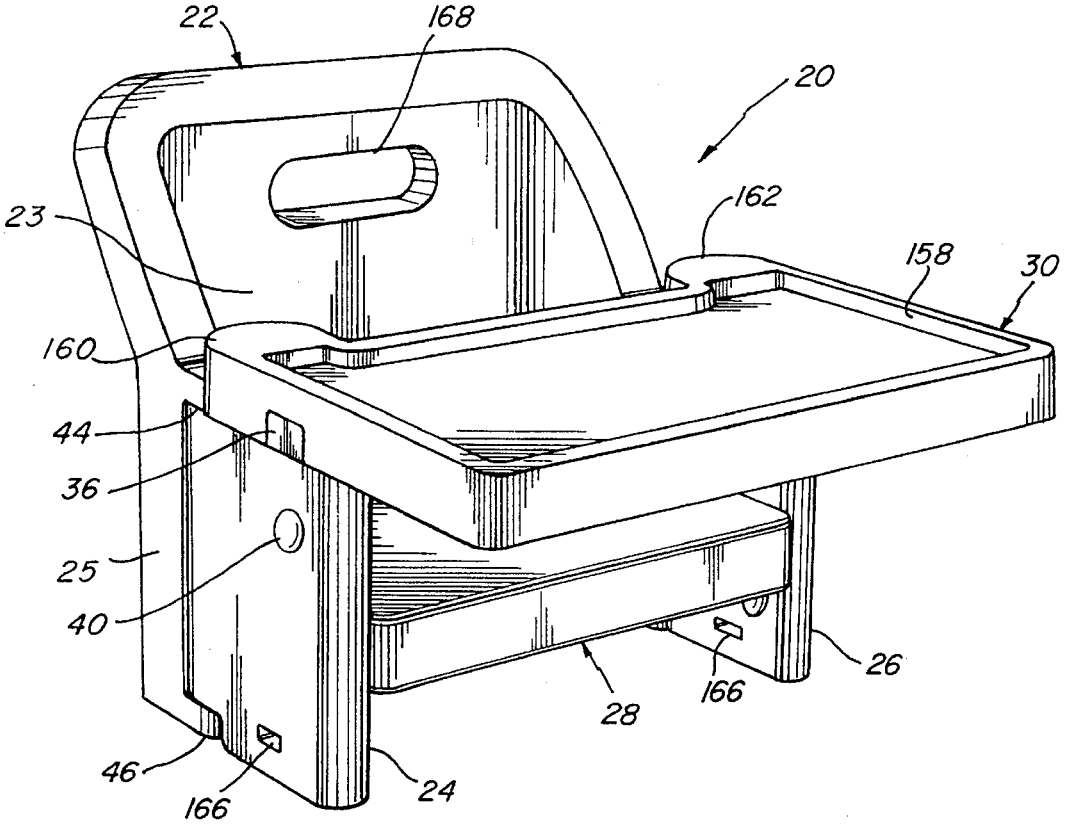
FIG. 1 is a perspective view of the booster seat illustrating a preferred embodiment of this invention.

A preferred embodiment of the booster seat in an operative configuration is generally indicated at 20 in FIG. 1. The booster seat 20 is comprised of a back member 22, two arms 24 and 26 pivotally connected to side edges 25 and 27 of the back member 22, a reversible seat panel 28, and a multi-position, detachably connected tray 30.

Figure 9:
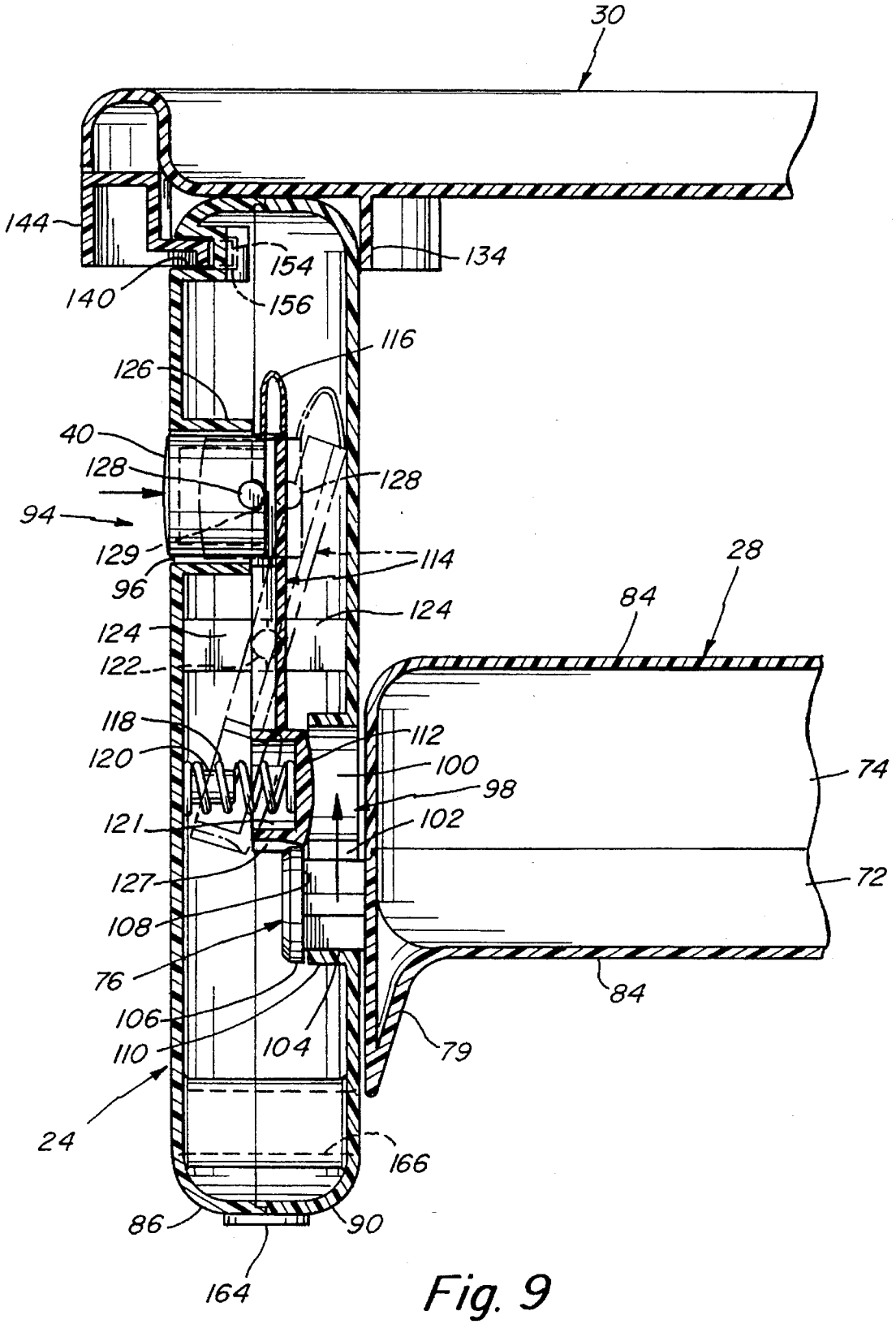
FIG. 9 is a fragmentary cross-sectional view taken along section line 9—9 of FIG. 7 illustrating the seat latch in the locked and unlocked positions.
Figure 10:
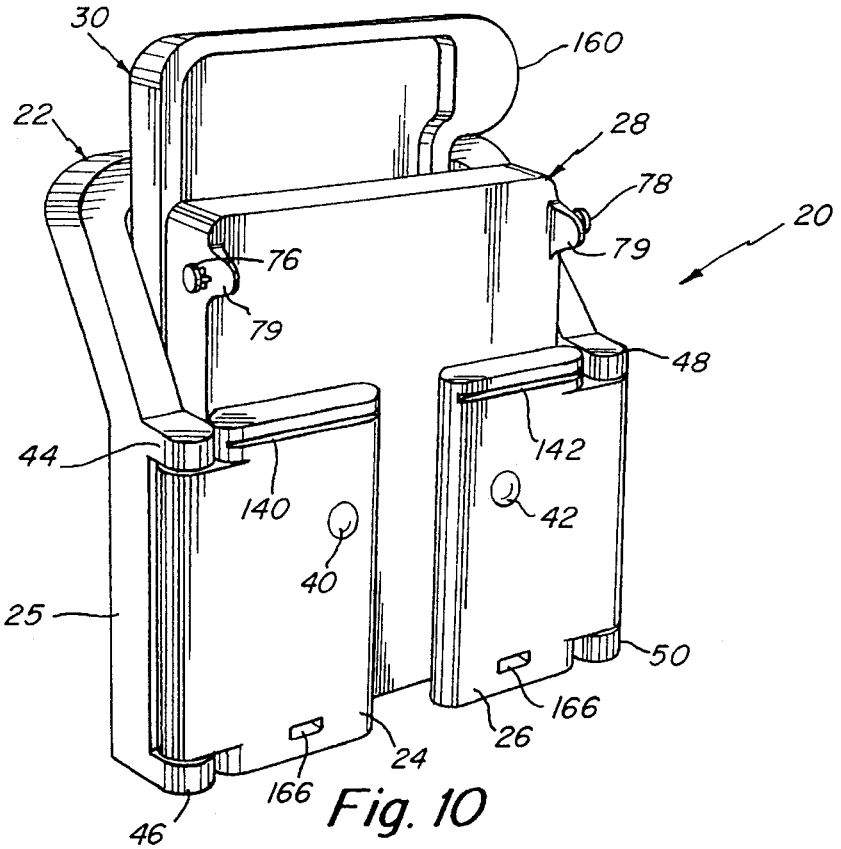
FIG. 10 is a perspective view of the booster seat in the stowed configuration.
Figure 11:
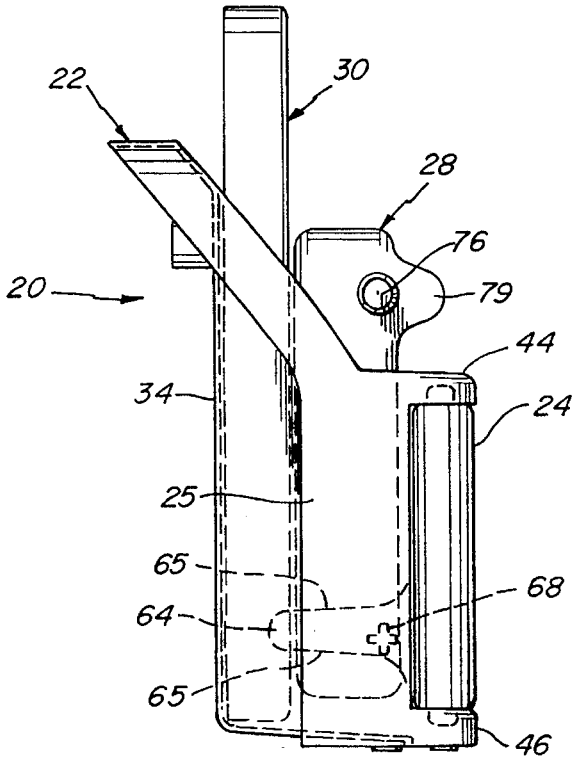
FIG. 11 is a side elevational view of the booster seat in the stowed configuration.

The preferred embodiment of the booster seat in a stowed configuration is shown in FIGS. 10 and 11. The stowed configuration is achieved by dismantling the booster seat whereby the tray is detached from the arms 24 and 26, the seat panel 28 may then be unlocked from the arms 24 and 26 and pivoted within the back member 22 to a generally vertical position, the arms 24 and 26 are then pivotally rotated toward each other and aligned to each other in positions generally parallel to the vertical seat panel 28, and lastly the detached tray 30 is finally placed between the seat panel 28 and the rear wall 34 of the back member 22. The tray 30 is detached from the booster seat by releasing two tray latches 36 and 38, located on each side of the tray 30, and sliding the tray 30 forwardly and away from the back member 22 until it is free from the arms 24 and 26. The seat panel 28 is detached from arms 24 and 26 by depressing two seat release buttons 40 and 42 located on the arms 24 and 26, which unlock seat latches shown at 94 in FIGS. 7 and 9 and hereinafter described, and pivoting the arms 24 and 26 outwardly and away from the seat panel 28 as shown in FIG. 5.

Figure 7:
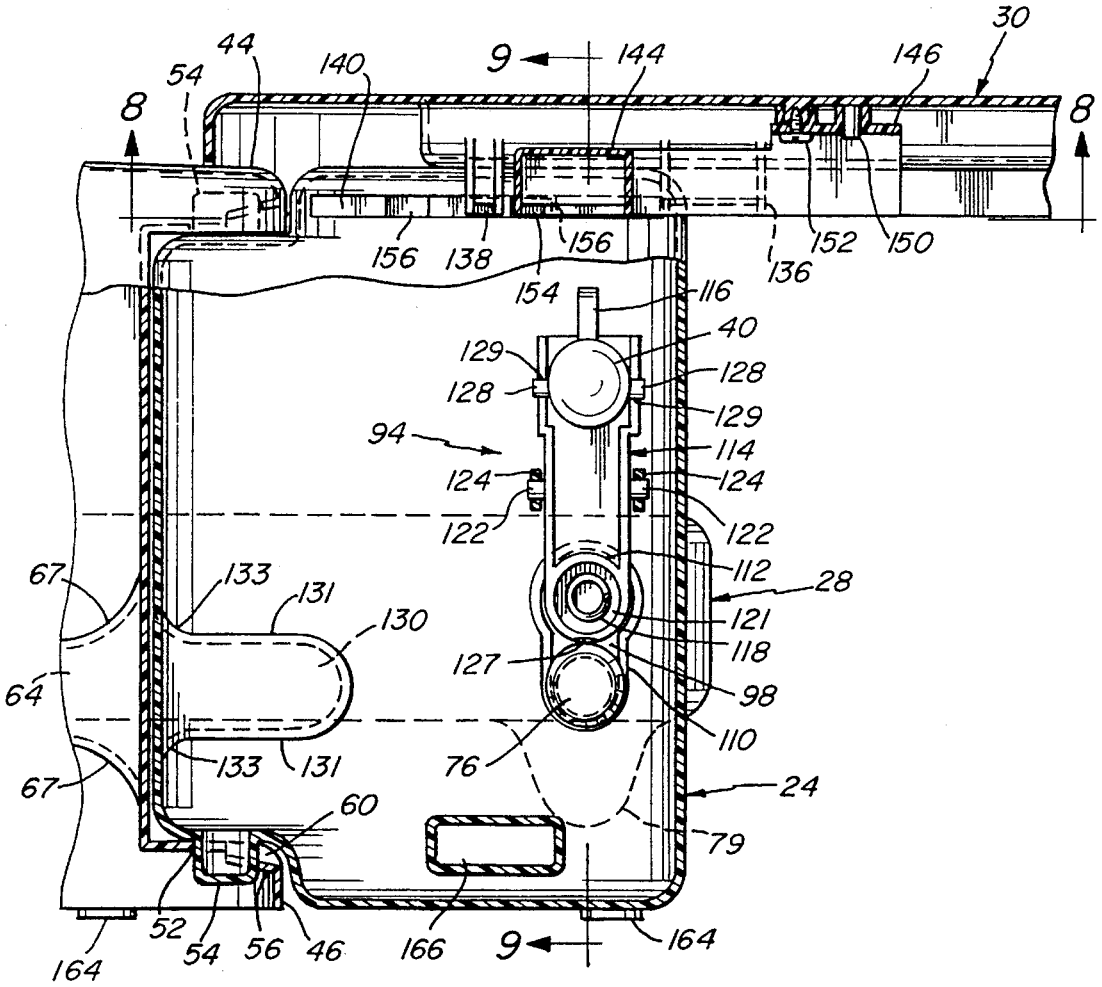
FIG. 7 is a fragmentary cross-sectional view taken along section line 7—7 of FIG. 4 illustrating the seat panel locking mechanism and the attachment of the tray to an arm.
Figure 8:
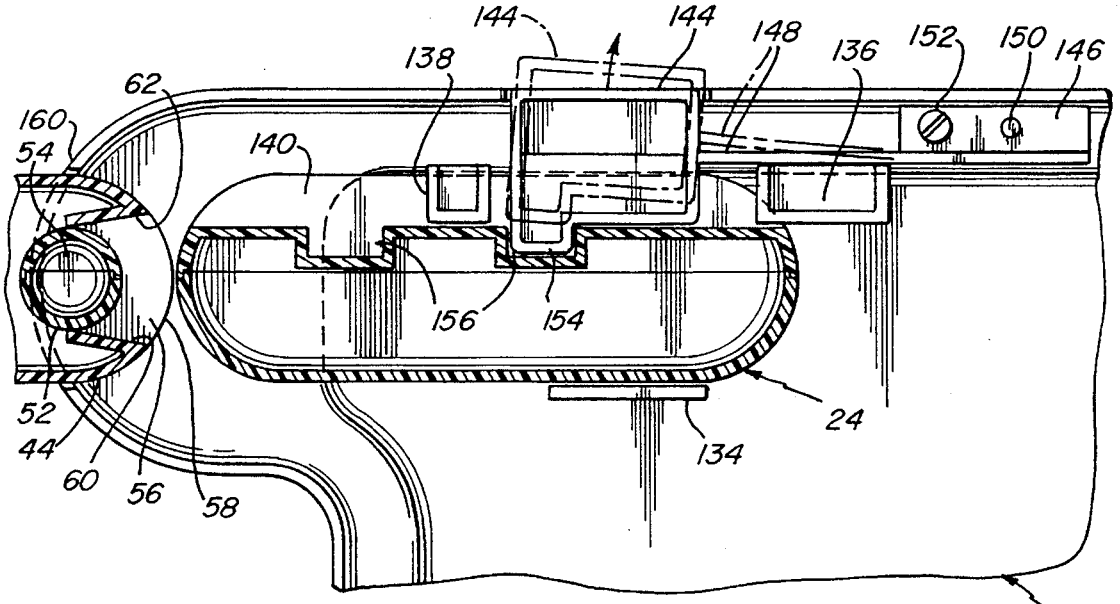
FIG. 8 is an enlarged fragmentary cross-sectional plan view taken along section line 8—8 of FIG. 7 illustrating the guiding and locking mechanism for attaching the tray to an arm and showing the tray latch in the locked and unlocked positions.

The back member 22 is a one piece structure molded of a plastic material, such as a colored polypropylene copolymer, in a manner generally known in the art. The other major parts of this booster seat 20 may similarly be molded of this same material in the same or different colors. As shown in FIGS. 1 and 10, the arms 24 and 26 are pivotally connected to hinge flanges 44, 46, 48 and 50 which protrude forwardly and away from the side edges 25 and 27 of the back member 22. Each of the hinge flanges 44–50 contains an opening 52, as shown in FIGS. 7 and 8, into which arm pivots 54, provided on the rear top and bottom of the arms 24 and 26, extend to form a hinged mechanism. Referring to FIG. 8, each of the hinge flanges 44–50 is formed with a ramp 56, which slopes from the front edge 58 of a hinge flange 44–50 toward the opening 52, and angled guide walls 60 and 62, which converge toward each other from the front edge 58 toward the opening 52. The assembly of the side arms 24 and 26 to the back member 22 is facilitated by virtue of the guiding action of the ramps 56 and converging walls 60 and 62 acting on the arm pivots 54.

Figure 2:
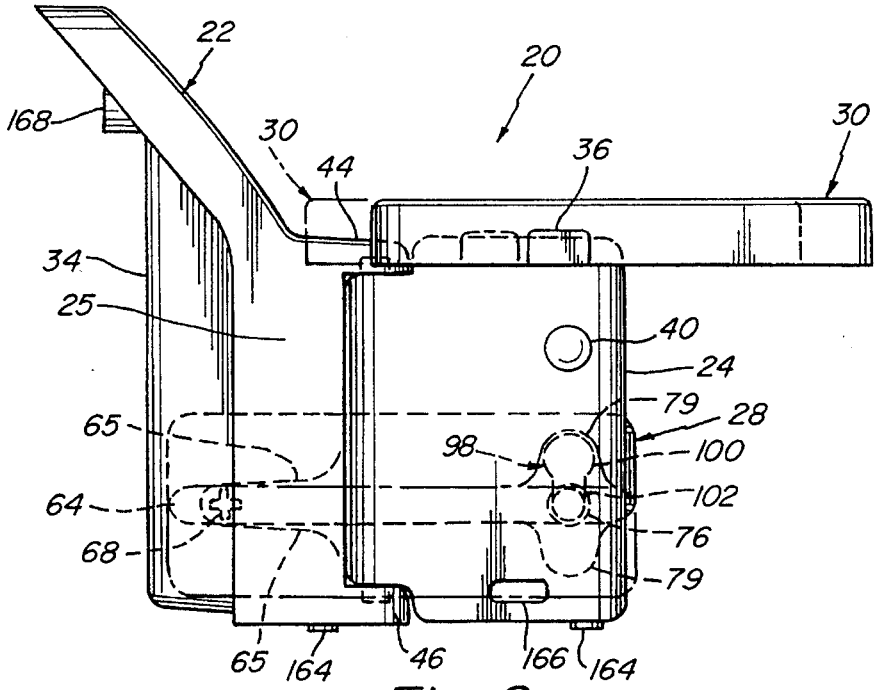
FIG. 2 is a side elevational view of the booster seat of FIG. 1.
Figure 5:
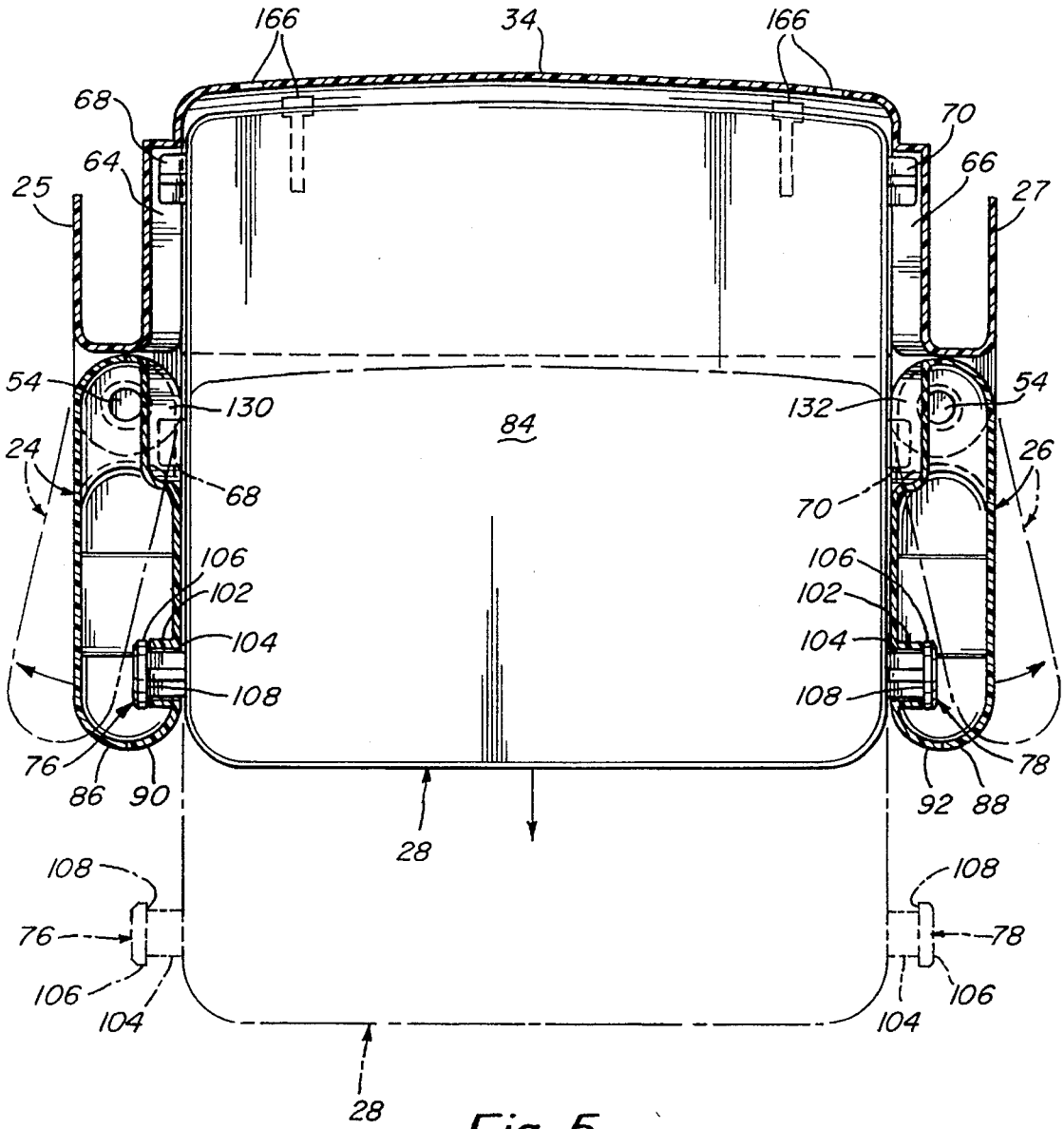
FIG. 5 is a cross-sectional plan view taken along section line 5—5 of FIG. 4 illustrating the manner in which the seat panel and the arms are assembled.
Figure 6:
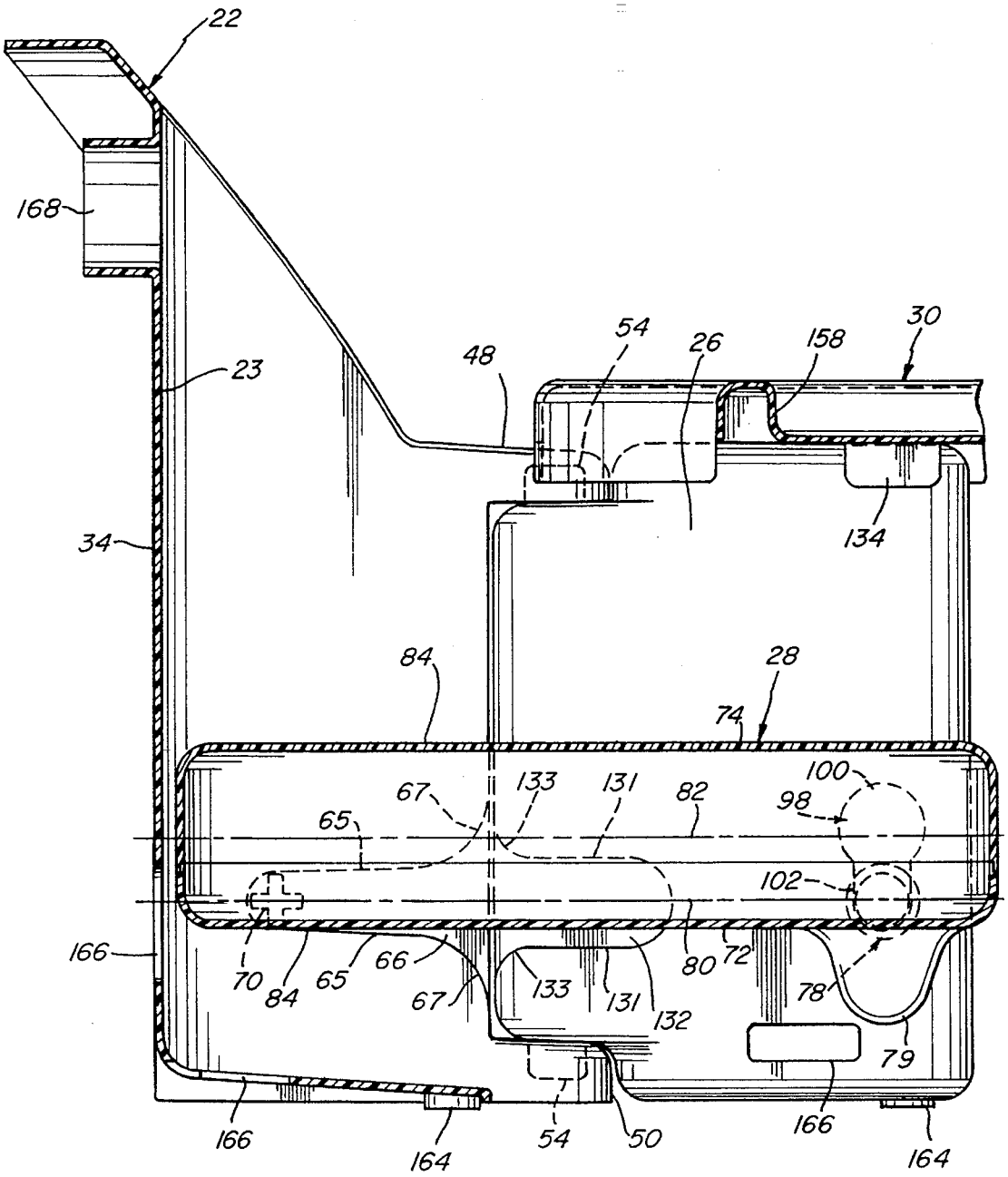
FIG. 6 is a cross-sectional side elevational view taken along section line 6—6 of FIG. 3.

Referring to FIGS. 5 and 6, support channels 64 and 66 are formed in the lower portion of the back member 22, which slidably engage two rear lugs 68 and 70 provided on the seat panel 28. The channels 64 and 66 are formed by two opposed walls 65, as shown in FIGS. 2 and 6, which converge toward each other from the front of the back member 22 toward the rear wall 34. Each wall 65 is formed with a diverging radius 67 at the entrance to the channels 64 and 66 to facilitate the assembly of the seat panel 28 to the back member 22 by providing a guiding action to the rear lugs 68 and 70 during assembly. The channels 64 and 66 act as connecting members and support the rear portion of seat panel 28 when in the operative position for supporting a child and retain the rear portion of seat panel 28 when it is pivoted to a vertical position in the stowed configuration of the booster seat 20.

A child is physically supported in the back member 22, by the upper portion 23 of the rear wall 34 and the side edges 25 and 27, located above the seat panel 28. The upper portion of the seat member 22 may be formed in various shapes and contours to best provide for the comfort and safety of a child.

The seat panel 28 is a two piece structure, comprised of a seat bottom 72 and seat top 74, molded of a plastic material and with the two pieces joined together in a manner generally known in the art. Referring to FIGS. 6 and 9, the seat bottom 72 is molded with connecting members in the form of two rear lugs 68 and 70 and two forward lugs 76 and 78. As shown in FIGS. 6 and 10, radial ears 79 are formed around the forward lugs 76 and 78 to improve the structural integrity of the seat panel 28. The seat top 74 is of greater height than the seat bottom 72 as measured from a horizontal mounting plane established by the lugs 68, 70, 76 and 78. The seat bottom 72 and seat top 74 each provide a seating surface 84 upon which to support an occupant. It is preferred that each seating surface 84 be formed with a textured surface to increase the friction between the occupant and the seat panel 28, and thereby decrease the possibility of a child slipping off the seat panel 28.

Figure 4:
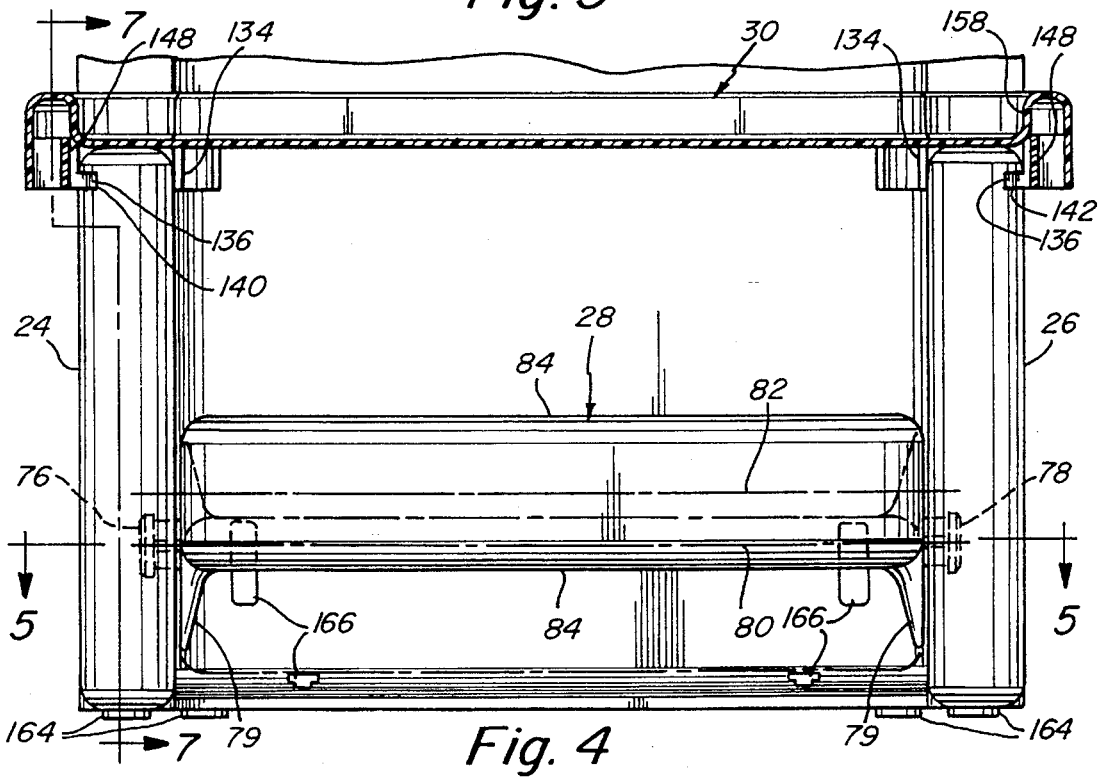
FIG. 4 is a cross-sectional view taken along section line 4—4 of FIG. 3 illustrating the seat panel in alternate positions that afford the ability to select the desired height of the seating surface.

The seat panel 28 may be selectively positioned to adjust the seat height to accommodate growing children. Referring to FIGS. 4 and 6, this is achieved by the horizontal mounting plane 80 which is offset from a central horizontal plane 82, which is established at the geometric center between the opposed seating surfaces 84. This allows the seating surface 84 to effectively be lowered or raised simply by inverting the seat panel 28.

The arms 24 and 26, which are mirror images of each other, are two piece structures, comprised of outer arms 86 and 88 and inner arms 90 and 92, molded of a plastic material and with the two pieces joined together in a manner generally known in the art. Referring to FIGS. 7 and 9, the outer arms 86 and 88 and inner arms 90 and 92 support and retain seat latches 94 within each of the arms 24 and 26, which provide a locking mechanism for the booster seat. The outer arms 86 and 88 contain circular openings 96 formed by a tubular support wall 126 that extends into the arms 24 and 26 along the perimeter of the openings 96. The openings 96 support and guide the seat release buttons 40 and 42 within the arms 24 and 26. The inner arms 90 and 92 contain keyhole openings 98 formed with an upper portion 100, a lower portion 102, and a support wall 110 that extends into the arms 24 and 26 along the perimeter of the openings 98. The keyhole openings 98 act as connecting members to support and retain the forward lugs 76 and 78 of the seat panel 28 within the arms 24 and 26 when the booster seat 20 is in the operative configuration of FIG. 1. Children are prevented from injuring their fingers and hands in the upper portion 100 of the keyhole 98, which is covered by the seat panel 28 when positioned in the upper height, and by the ears 79 when the seat panel 28 is inverted to the lower height, as shown in FIG. 2.

A stable and rigid booster seat 20 is achieved with a connecting mechanism that engages the seat panel 28 to the back member 22, and then locks the seat panel 28 to the arms 24 and 26. Referring to FIG. 5, the rear lugs 68 and 70 are first slidably engaged into the support channels 64 and 66 of the back member 22. Referring to FIGS. 6 and 9, the seat panel 28 is then connected to the arms 24 and 26 by inserting the forward lugs 76 and 78 into the upper portion 100 of the keyhole openings 98 and lowering the front of the seat panel 28 to engage the forward lugs 76 and 78 in the lower portion 102 of the keyhole openings 98. The forward lugs 76 and 78 are formed with a minor diameter shaft 104 and a major diameter tip 106. The shaft 104 and tip 106 are sized to ensure that the forward lugs 76 and 78 may only be installed into and removed from the arms 24 and 26 through the upper portion 100 of the keyhole openings 98, but may then be locked and supported in the lower portion 102. The size differential between the shaft 104 and the tip 106 creates a circumferential lip 108 to engage the keyhole wall 110, and prevent the arms 24 and 26 from being pivoted away from the forward lugs 76 and 78, when the seat panel 28 is in the locked position.

With the booster seat 20 in the functional configuration, the seat panel 28 is prevented from being raised from the locked position by an interference created between the seat latches 94 and the forward lugs 76 and 78. Referring to FIGS. 7 and 9, the seat latches 94 are formed with a locking member 112 located at one end of a latch lever 114, and a seat release button 40 attached to the opposite end of the latch lever 114 by an integral flexible strap 116. It should be apparent that the seat release button 40 may be provided as a part separate from the seat latch 94, although this is not preferred because of the additional expense associated with procurement, inventory and assembly, and the likelihood that the buttons would be lost. In the locked configuration, the locking member 112 aligns with and obstructs the upper opening 100 of the keyhole opening 98. The seat latches 94 are positively locked into position by a seat latch spring 118 which is located and retained in the arms 24 and 26 by a spring post 120, and a recess 121 formed in the rear of the locking member 112. The seat latch spring 118, which is a compression type spring, maintains the seat latch 94 in its locked position by exerting a force between the outer arms 86 and 88 and the locking member 112. This force rotates the latch lever 114 on two seat latch pivots 122, which are positioned opposite each other on the latch lever 114 between the locking member 112 and release button 40, and are supported by pivot supports 124. The seat latches 94 are prevented from over-rotating into the upper opening 100 by the opening support wall 126, which engages and positions the latch lever 114 in a generally vertical position, with the locking member 112 located above the tip 106. As shown in FIGS. 7 and 9, an angled, radially shaped detent 127 is formed in the bottom of the locking member 112 to engage the tip 106. The locking capability of the seat latch 94 is enhanced by the increased contact area between the locking member 112 and the tip 106 provided by the radial shape of the detent 127, which conforms with the radius of the tip 106. The locking capability is further enhanced by the angle of the detent 127, which positively engages the lip 108 should the seat panel 28 be raised without first unlocking the seat latch 94, thereby drawing the locking member 112 toward the upper opening 100 and maintaining it over the forward lugs 76 and 78.

The procedure for unlocking the seat panel 28 from the arms 24 and 26, is initiated by depressing each release button 40 and 42. This force is transmitted to the end of the latch lever 114 opposite the locking member 112 through the button pivots 128, as shown in FIGS. 7 and 9, which are positioned opposite each other on the circumference of the buttons 40 and 42, and seated on two button pivot supports 129 located on that end of the latch lever 114. The locking member 112 is rotated around the seat latch pivots 122, and out of the upper opening 100 of the keyhole opening 98. The button pivots 128 prevent the seat release buttons 40 and 42 from binding on the opening support wall 126 during this unlocking operation by allowing the relative angle between the buttons 40 and 42 and the latch lever 114 to continually change during the unlocking sequence. Once the locking members 112 have been rotated clear of the upper openings 100, the seat panel 28 may be raised to align the forward lugs 76 and 78 with the upper openings 100. Referring to FIG. 5, the arms 24 and 26 may then be pivoted away from the seat panel 28 and each other until the forward lugs 76 and 78 are free of the key hole openings 98.

Once the seat panel 28 is unlocked from the arms 24 and 26, it may then be either pivoted to the generally vertical position for stowage, as shown in FIGS. 10 and 11, or inverted to selectively adjust the height of the seating surface 84. The seat panel 28 may be detached from the back member 22 by sliding the rear lugs 68 and 70 out from the support channels 64 and 66 to the arm recesses 130 and 132 formed in the arms 24 and 26. The arm recesses 130 and 132 are formed by two generally parallel and opposed walls 131, as shown in FIGS. 6 and 7, and a radius 133 formed on each wall 131 at the entrance to the recesses 130 and 132. When the rear seat lugs 68 and 70 have been disposed in the arm recesses 130 and 132, the arms 24 and 26 may be fully pivoted away from each other allowing the seat panel 28 to be removed.

The tray 30 is a one piece structure molded of a plastic material in a manner generally known in the art. As shown in FIGS. 8 and 9, the tray 30 is formed with an inside guide lug 134, an outside forward guide lug 136, and an outside rear guide lug 138 located on each side of the tray 30. The tray 30 is detachably connected to the arms 24 and 26, whereby the outer guide lugs 136 and 138 are slid into and engage the tray guide slots 140 and 142 provided in the upper portions of the arms 24 and 26. The outside guide lugs 136 and 138 are L-shaped, as shown in FIG. 4, to prohibit the tray 30 from being lifted in the vertical direction and off the arms 24 and 26.

Figure 3:
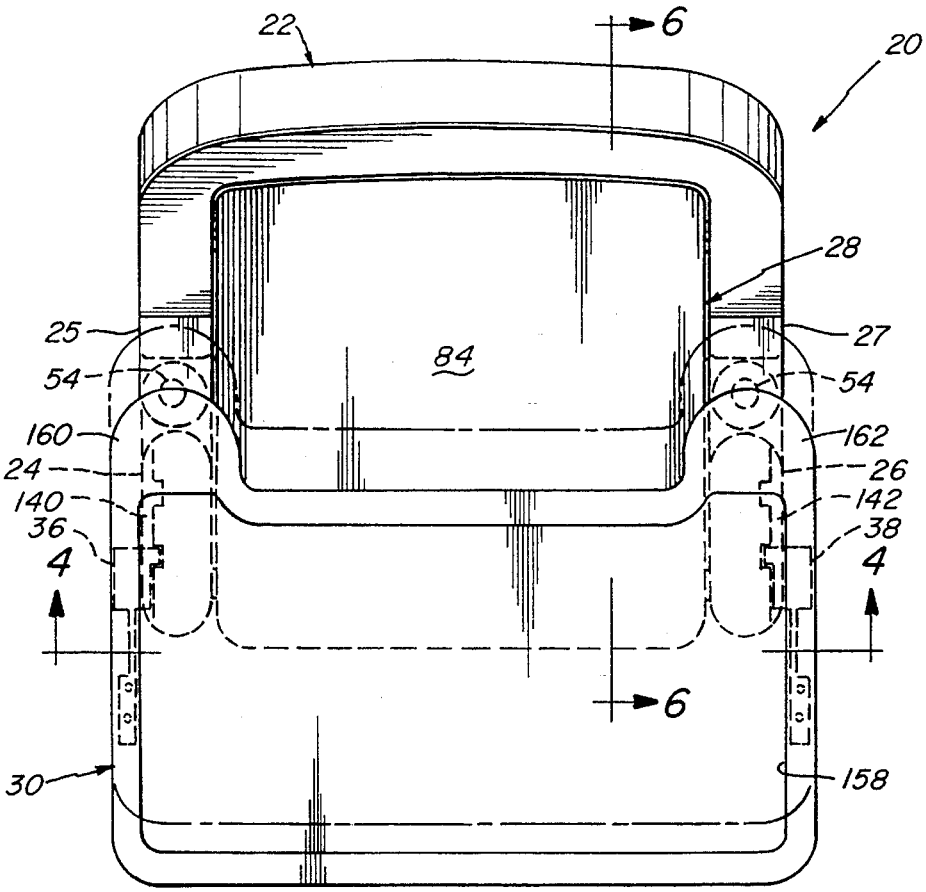
FIG. 3 is a top plan view of the booster seat illustrating the tray in multiple positions.

Referring to FIG. 3, the tray 30 is locked into one of two available positions and prevented from sliding therefrom by the tray latches 36 and 38. As shown in FIG. 8, each of the latches 36 and 38 is formed with a catch body 144 connected to a latch anchor 146 by an integral flexible hinge 148. The tray latches 36 and 38 are detachably connected to the tray 30 with a pin 150 and a fastener 152. The catch body 144 is formed with a catch lug 154 which engages either of the two detents 156 located within the tray guide slots 140 and 142, and locks the tray 30 in the desired position. While the preferred embodiment shows two detents 156 formed within each guide slot 140 and 142, the number of detents 156 may be varied to increase or decrease the available lock positions for the tray 30. The tray 30 is formed with a side wall 158 around the entire perimeter to provide a surface which will retain, among other things, eating utensils, spilled liquids, and children's toys. Further, to improve the comfort of the booster seat 20, while occupied by a child, the tray 30 is formed with two radially shaped rear edges 160 and 162, which allow the child to rest his or her arms thereon.

The safety of the booster seat 20 is enhanced by a non-slip bottom created by a plurality of widely available rubber buttons 164, which are connected to the bottom of the back member 22, and the arms 24 and 26, as shown in FIGS. 2 and 6. Nylon webbed or similar type straps (not shown), which are widely known and commercially available, are provided to secure the booster seat 20 on a chair or other base, and to secure a child in the booster seat 20. As shown in FIGS. 1, 6 and 10, openings 166 are formed in each of the arms 24 and 26, which are used in configuration with the straps (not shown) to secure the booster seat 20 to a chair or other base. Referring to FIGS. 4 and 5, similar openings are also provided in the back member 22 to secure the booster seat 20 or a child in the seat 20.

The portability of the booster seat 20 is enhanced by an easy grip handle 168 molded into the upper portion of the back member 22.

What is claimed is:

1. A booster seat comprising:

a molded back member having an upper portion for supporting the back of a child in the seat, a lower portion for engaging a seat panel, and sides for engaging a pair of arms, one on each side of the back member;

a pair of arms, each having a front portion, a rear portion and an upper portion, the rear portion of one arm being pivotally connected to each side of the back member on a generally vertical axis so that the arms may be pivoted toward and away from each other while connected to the back member; and an invertible seat panel having front and rear portions, the rear portion of the seat panel being detachably connected to the lower portion of the back member, the front portion of the seat panel being detachably connected to the front portion of each arm, the seat panel including generally horizontal seating surfaces on opposite faces thereof, one of the seating surfaces facing upwardly for elevating a child above a supporting surface, the seat panel being invertible to adjust the height of the upwardly facing seating surface relative to the supporting surface.

2. The booster seat as defined in claim 1, wherein the arms may pivot when the seat is detached from the arms so that the arms are generally parallel to and spaced from the back member in a first position and the arms extend forwardly from the back member in a second position.

3. The booster seat as defined in claim 2, wherein the rear portion of the seat panel is pivotally connected to the lower portion of the back member so that the seat panel may pivot upwardly to a collapsed position generally parallel to the back member and disposed between the back member and the arms in the first position.

4. The booster seat as defined in claim 3, wherein a locking member locks the seat panel to the arms so that the back member, the arms and the seat panel are held in fixed position with respect to one another in the second position, the seat panel being detachable from the arms when the locking member is released.

5. The booster seat as defined in claim 3, further comprising a tray including latches disposed on opposite sides thereof for attaching the tray to the upper portions of the arms, the tray being detachable from the arms when the latches are released.

6. The booster seat as defined in claim 5, wherein the back member and the arms in the first position form a cavity therebetween for receiving both the seat panel and the tray when the tray is detached from the arms, the tray being oriented in the cavity generally parallel to the arms in the first position.

7. The booster seat as defined in claim 3, wherein the front portion of each arm has a recess, the lower portion of the back member has channels and the seat panel includes front lugs disposed on the front portion of the seat panel for engaging the recesses in the arms in the second position and rear lugs disposed on the rear portion of the seat panel for engaging the channels in the back member, the front and rear lugs being located closer to one seating surface than the other seating surface so that the seat panel may be inverted to selectively adjust the height of the upwardly facing seating surface.

8. The booster seat as defined in claim 1, wherein a locking member locks the seat panel to the arms so that the back member, the arms and the seat panel are held in fixed position with respect to one another, the seat panel being detachable from the arms when the locking member is released.

9. The booster seat as defined in claim 1, further comprising a tray and the arms for attaching the tray to the arms, the tray being detachable from the arms when the latching mechanism is released.

10. A booster seat comprising:

a molded back member having an upper portion for supporting the back of a child in the seat, a lower portion for engaging a seat panel, and sides for engaging a pair of arms, one arm on each side of the back member;

a pair of arms having front and rear portions, the rear portion of one arm being pivotally connected to each of the sides of the back member on a generally vertical axis so that the arms can pivot between a first position and a second position, the arms being substantially coplanar to each other and adjacent the back member in the first position, the arms extending forwardly from the back member and being generally parallel to each other in the second position, the front portion of each arm having a hole; and a seat panel including generally parallel seating surfaces on opposed faces thereof, sides having front and rear portions connecting the other, front lugs protruding from the front portions of the sides for engaging the holes in the front portions of the arms in the second position and rear lugs protruding from the rear portions of the sides for pivotally engaging in the lower portion of the back member so that the seat panel may pivot upwardly to a collapsed position generally parallel to the back member and disposed between the back member and the arms in the first position, the front and rear lugs being located closer to one seating surface than the other seating surface so that the seat panel may be inverted to selectively provide seating surfaces of different height relative to the supporting surface.

11. A booster seat comprising:

a back member having an upper portion for supporting the back of a child in the seat, a lower portion with channels for engaging a seat panel, and sides for engaging a pair of arms, one on each side of the back member;

a pair of arms, each having a front portion, a rear portion and an upper portion, the front portion of each arm having a recess, the rear portion of one arm being pivotally connected to each of the sides of the back number on a generally vertical axis so that the arms may be pivoted between an operative position wherein the arms extend forwardly from the back member and a collapsed position wherein the arms are substantially coplanar with one another and adjacent the back member; and a seat panel having sides with front and rear lugs extending outwardly therefrom; the rear lugs being slidably connected to the channels in the lower portion of the back member, the front lugs being connected to the recesses in the front portions of the arms.

12. The booster seat as defined in claim 11, wherein a locking member locks the seat panel to the arms so that the back member, the arms and the seat panel are held in fixed position with respect to one another in the operative position, the seat panel being detachable from the arms when the locking member is released.

13. The booster seat as defined in claim 10, further comprising a tray including latches disposed on opposite sides thereof for attaching the tray to the upper portions of the arms, the tray being detachable from the arms when the latches are released.

14. The booster seat as defined in claim 13, wherein the back member and the arms in the first position form a cavity therebetween for receiving both the seat panel and the tray when the tray is detached from the arms, the tray being oriented in the cavity generally parallel to the arms in the collapsed position.

15. A booster seat comprising:

a back member having an upper portion for supporting the back of a child in the seat, a lower portion having openings for engaging a seat panel, and sides for engaging a pair of arms, one on each side of the back member;

a pair of arms having front and rear portions, the rear portion of one arm being pivotally connected to each of the sides of the back member on a generally vertical axis so that the arms may pivot between a first position and a second position, the arms being substantially coplanar to each other and adjacent the back member in the first position, the arms extending forwardly from the back member and generally parallel to each other in the second position, the front portion of each arm having an opening; and a seat panel including generally parallel seating surfaces on opposed faces thereof, sides connecting the seating surfaces to each other and projections extending from the sides for engaging the openings in the front portion of each arm and the lower portion of the back member, the projections on the seat panel being located closer to one seating surface than the other seating surface so that the seat panel may be reversed to selectively provide seating surfaces of different height in the booster seat when inverted.

16. A booster seat comprising:

a molded back member having an upper portion for supporting the back of a child in the seat, a lower portion for engaging a seat panel, and sides for engaging a pair of arms, one on each side of the back member;

a first pair of connecting members on the lower portion of the back member;

a pair of arms, one pivotally connected to each of the sides of the back member on a generally vertical axis so that the arms may be pivoted toward and away from each other while connected to the back member, the arms having front, rear and upper portions;

a second pair of connecting members, one on the front portion of each of the arms; and a seat panel having generally parallel seating surfaces on opposite faces thereof, and third and fourth pairs of connecting members releasably mating respectively with the first and second pairs of connecting members for releasably connecting the seat panel to the back member and arms, the third and fourth pairs of connecting members located closer to one of the seating surfaces than the other, whereby the seat panel may be reversed so as to selectively provide seating surfaces of different height in the booster seat when the seat panel is inverted.

17. The booster seat as defined in claim 16, wherein the arms are pivotable between a first collapsed position wherein the arms are generally parallel to and spaced from the back member when the seat panel is detached from the arms and a second operative position wherein the arms extend forward from the back member.

18. The booster seat as defined in claim 17, wherein the first and third pairs of connecting members pivotally connect the seat panel to the back member so that the seat panel may pivot upwardly to a collapsed position generally parallel to the back member and be positioned between the back member and the arms when the arms are in the first collapsed position.

19. The booster seat as defined in claim 18, wherein a locking member is operatively associated with the second and fourth pairs of connecting members for locking the back member, arms and seat panel in a fixed position with respect to one another.

20. The booster seat as defined in claim 16, wherein a locking member is operatively associated with the second and fourth pairs of connecting members for locking the back member, arms and seat panel in a fixed position with respect to one another.

21. The booster seat as defined in claim 16, further comprising a tray including latching means disposed on opposite sides thereof for attaching the tray to the upper portions of the arms, the tray being detachable from the arms when the latching means are released.

22. A booster seat comprising:

a back member having sides and a lower portion;

a pair of arms;

a seat panel having generally parallel seating surfaces on opposite sides thereof;

a hinged mechanism pivotally connecting one of the arms to each side of the back member enabling each arm to pivot between a collapsed position wherein the arms lie substantially parallel to and spaced from the back member and an operative position wherein the arms extend forward from the sides of the back member and generally parallel to and spaced from one another; and a connecting mechanism mounted on the seat panel for detachably connecting the seat panel to the arms and back member when the arms are in the operative position and enabling the seat panel to be removed so that it may be stored in the space between the arms and back member when the arms are in the collapsed position;

said connecting mechanism being closer to one of the seating surfaces than the other enabling the seat panel to be selectively connected to the arms with either seating surface facing upwardly and wherein one of the seating surfaces is higher than the other when each faces upwardly;

the arms having a length dimension measure from front to rear when they are in the operative position, the length being less than half the width of the back member so that the arms do not overlap one another in the collapsed position.

23. The booster seat as defined in claim 22, further comprising:

a tray dimensionally capable of fitting with the seat panel in the space between the arms and back member when the arms are in the collapsed position; and a latching mechanism in part mounted on the tray or detachably mounting the tray on the arms when the arms are in the operative position.

* * * * *